US007508179B2

(12) United States Patent
Cowell et al.

(10) Patent No.: US 7,508,179 B2
(45) Date of Patent: Mar. 24, 2009

(54) DUAL INPUT PRIORITIZED LDO REGULATOR

(75) Inventors: Andrew Cowell, Greytown (NZ); David Wayne Ritter, San Jose, CA (US)

(73) Assignee: Micrel, Incorporated, San Jose, CA (US)

( * ) Notice: Subject to any disclaimer, the term of this patent is extended or adjusted under 35 U.S.C. 154(b) by 312 days.

(21) Appl. No.: 11/557,079

(22) Filed: Nov. 6, 2006

(65) Prior Publication Data

US 2008/0122416 A1 May 29, 2008

(51) Int. Cl.
*G05F 1/565* (2006.01)
*G05F 1/40* (2006.01)

(52) U.S. Cl. ..... 323/275; 323/276; 323/274

(58) Field of Classification Search ..... 323/268, 323/271, 273, 274, 275, 276, 282, 284, 285, 323/350, 351

See application file for complete search history.

(56) References Cited

U.S. PATENT DOCUMENTS 6,150,798 A * 11/2000 Ferry et al. ..... 323/273
6,229,289 B1 * 5/2001 Piovaccari et al. ..... 323/268
7,064,531 B1 6/2006 Zinn
7,196,501 B1 * 3/2007 Dunipace ..... 323/273
7,230,408 B1 * 6/2007 Vinn et al. ..... 323/273

* cited by examiner

*Primary Examiner*—Jessica Han
(74) *Attorney, Agent, or Firm*—Bever, Hoffman & Harms, LLP; Patrick T. Bever

(57) ABSTRACT

An LDO regulator includes two linear regulator circuits and an internal priority logic scheme that favors generating a regulated output voltage using a regulated supply voltage over an unregulated supply voltage. The unregulated supply voltage is applied to a first input terminal from a raw voltage source. The regulated supply voltage is applied to a second input terminal from, for example, a switching (e.g., BUCK) regulator. Two output devices are respectively connected between the first and second input terminals and the LDO output terminal. The first regulator circuit causes the first output device to supply the desired regulated output voltage while the switching regulator ramps up. Once the regulated supply voltage is high enough to allow regulation, the internal priority logic scheme disables the first regulator circuit, whereby the desired regulated output voltage is generated solely by the second regulator circuit through the second output device.

8 Claims, 3 Drawing Sheets

DUAL INPUT PRIORITIZED LDO REGULATOR

FIELD OF THE INVENTION

This invention relates to voltage regulators, and in particular to lowdrop out (LDO) regulators.

BACKGROUND OF THE INVENTION

FIG. 4 is a block diagram showing a system including a BUCK regulator 20, an LDO regulator 25, and a field programmable gate array (FPGA) 30 in a conventional arrangement. A raw voltage source (e.g., a battery) provides a relatively high, unregulated voltage $V_{RAW}$ that is supplied to BUCK regulator 20. BUCK regulator 20 supplies a relatively high regulated voltage $V_{I/O}$ (e.g., 3.3V) to the input/output (I/O) circuitry of FPGA 30 and to LDO regulator 25, and LDO regulator 25 provides a relatively low regulated voltage $V_{CORE}$ (e.g., 2.5V) to the core logic circuitry of FPGA 30.

FIG. 5 is a timing diagram illustrating the various voltages generated in the system of FIG. 4 during startup. First, unregulated voltage $V_{RAW}$ ramps up, and then after a brief delay BUCK regulator 20 begins generating relatively high regulated voltage $V_{I/O}$. Finally, after a time delay $T_{DELAY}$ needed to allow regulated voltage $V_{I/O}$ to reach a high enough voltage level to allow regulation, LDO regulator 25 begins to generate relatively low regulated voltage $V_{CORE}$.

The conventional arrangement described with reference to FIGS. 4 and 5 is highly efficient in that it minimizes the consumption of energy and the generation of heat. In particular, switching regulators, such as BUCK regulator 20, are able to regulate the higher I/O bus using the raw unregulated voltage $V_{RAW}$ in more efficient manner than linear regulators, such as LDO regulator 25. In contrast, linear regulators have an advantage over switching regulators in that they produce a relatively "quiet" (i.e., noise-free) regulated output voltage, but are not as efficient, particularly when the raw unregulated voltage $V_{RAW}$ is significantly higher than the desired regulated output voltage $V_{CORE}$. Therefore, to maximize efficiency, BUCK regulator 20 and LDO regulator 25 are connected in the series arrangement shown in FIG. 4 such that LDO regulator 25 is driven by regulated output voltage $V_{I/O}$, which is closer to the desired regulated output voltage $V_{CORE}$ than raw unregulated voltage $V_{RAW}$.

A problem arises when complex electronic systems, such as the system shown in FIG. 4, that incorporate electronic devices such as microprocessors, FPGAs, and digital application specific integrated circuits (ASICs), require sequencing of their power supplies in a manner that is inconsistent with the timing diagram shown in FIG. 5. In particular, it is often necessary for the core logic circuitry of FPGA 30 to receive power before the I/O circuitry so that peripheral devices remain under control during power up and power down sequences. Unfortunately, as indicated in FIG. 5, the power efficient conventional arrangement causes the relatively low regulated core voltage $V_{CORE}$ to necessarily lag the relatively high regulated I/O voltage $V_{I/O}$, which is contrary to the desired startup supply voltage sequence.

One current approach to addressing the sequencing problem described above is to use discrete diodes and multiple regulators to provide the necessary sequence. However, this approach is inconvenient and expensive.

What is needed is a LDO regulator that addresses the sequencing problem described above without requiring multiple discrete components.

SUMMARY OF THE INVENTION

The present invention addresses the sequencing problem described above by providing a dual input linear (e.g., LDO) regulator structure that includes two linear regulator circuits and an internal priority logic scheme that favors generating a regulated output voltage using a regulated supply voltage over an unregulated supply voltage. The unregulated supply voltage is applied to a first input terminal from, for example, a battery or other raw voltage source, and is supplied to the first linear regulator circuit. The regulated supply voltage is applied to a second input terminal from, for example, a switching regulator, and is supplied to the second linear regulator circuit. First and second output devices (e.g., bipolar transistors) are respectively connected between the first and second input terminals and the LDO output terminal. A first control circuit controls the first output device to supply the desired regulated output voltage during startup (e.g., while the regulated supply voltage is too low to allow regulation). This arrangement allows the LDO circuit to begin operation as soon as the unregulated supply voltage is available, thus providing the desired regulated output voltage before the slower (but more efficient) switching regulator is able to generate the regulated supply voltage. Once the regulated supply voltage is high enough to allow regulation, the internal priority logic scheme disables the first regulator circuit, whereby the desired regulated output voltage is generated solely by the second regulator circuit. Because the voltage level of regulated supply voltage is closer to regulated output voltage than the unregulated voltage, utilizing the second regulator circuit to generate the regulated output voltage after the startup period allows the LDO circuit to operate at greater efficiency by reducing power consumption and preventing unnecessary heating.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in voltage regulators. The following description is presented to enable one of ordinary skill in the art to make and use the invention as provided in the context of a particular application and its requirements. As used herein, the term "connected" is used herein to describe the direct connective relationship between two circuit elements (i.e., by way of a conductive wire or trace without an intervening circuit element), and is distinguished from the term "coupled", which indicates two circuit elements that are connected in a signal path but may be separated by zero or more electrical elements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
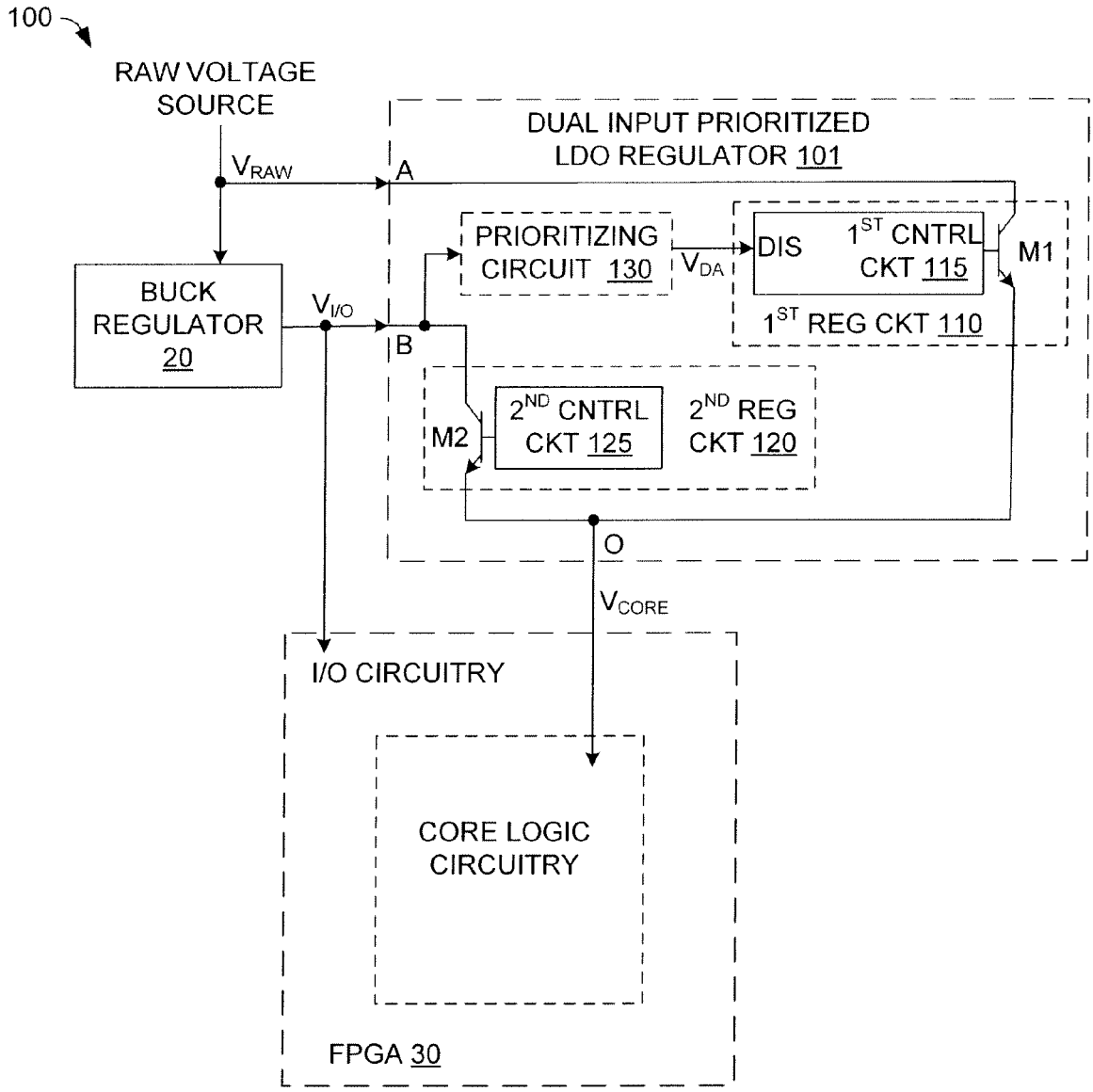
FIG. 1 is block diagram showing a system incorporating a dual input prioritizing LDO regulator according to an embodiment of the present invention.

FIG. 1 is a block diagram showing a system 100 including a conventional switching (e.g., BUCK) regulator 20, a conventional FPGA 30, and a dual input prioritized LDO regulator 101 according to an embodiment of the present invention. In the present embodiment, system 100 is made up of multiple discrete IC devices (i.e., BUCK regulator 20, conventional FPGA 30 and LDO regulator 101 are separately fabricated and assembled using known fabrication and assembling techniques). In an alternative embodiment, two or more of BUCK regulator 20, conventional FPGA 30 and LDO regulator 101 are integrally fabricated on a single semiconductor (e.g., monocrystalline silicon) substrate using, for example, BiCMOS fabrication techniques.

System 100 is similar to the conventional arrangement described above in that BUCK regulator 20 supplies a relatively high regulated voltage $V_{I/O}$ (e.g., 3.3V) to the I/O circuitry of FPGA 30, and LDO regulator 101 provides a relatively low regulated voltage $V_{CORE}$ (e.g., 2.5V) to the core logic circuitry of FPGA 30. In addition, similar to the system shown in FIG. 4, a raw voltage source (e.g., a battery) provides a relatively high, unregulated voltage $V_{RAW}$ that is supplied to BUCK regulator 20, which utilizes unregulated voltage $V_{RAW}$ to generate regulated voltage $V_{I/O}$ in a known, highly efficient manner. Further, regulated voltage $V_{I/O}$ is utilized both by the I/O circuitry of FPGA 30 and by LDO regulator 101 to generate regulated voltage $V_{CORE}$ in the manner described below.

Figure 4:
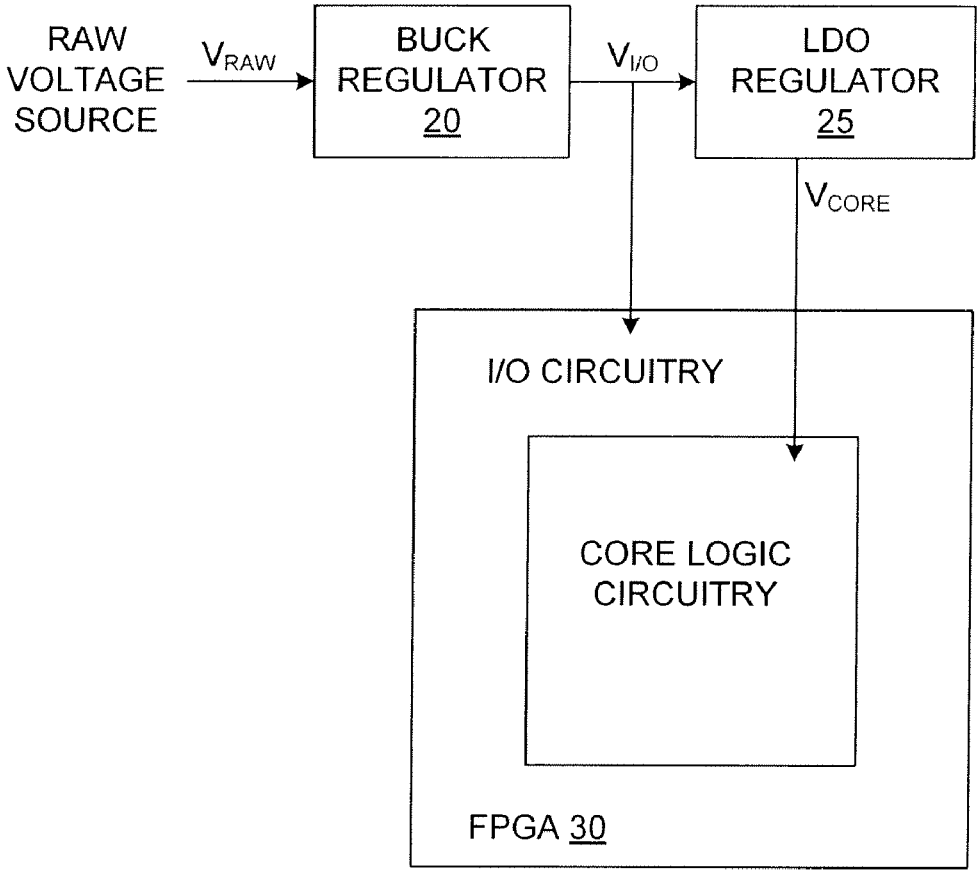
FIG. 4 (PRIOR ART)
FIG. 4 is block diagram showing a system including a conventional LDO regulator.
Figure 5:
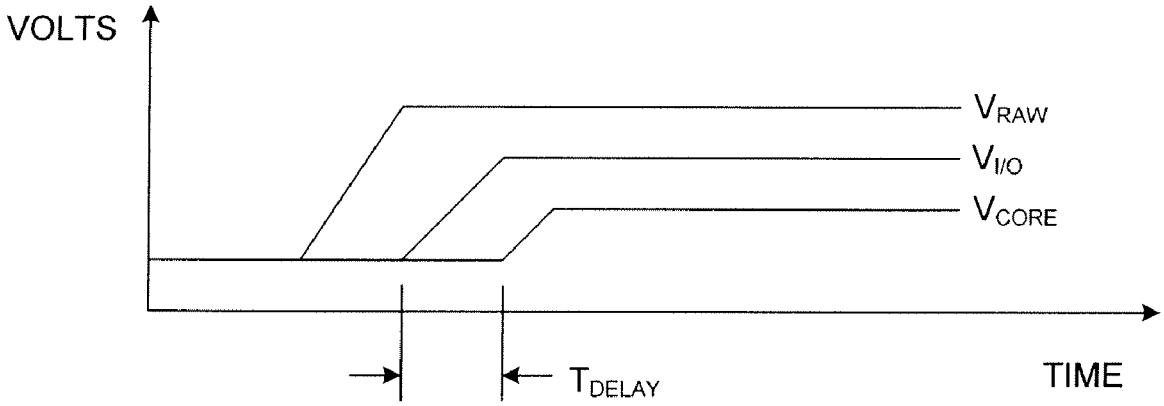
FIG. 5 (PRIOR ART)
FIG. 5 is timing diagram showing voltages generated in the system of FIG. 4 at startup.

The system shown in FIG. 1 differs from the conventional system of FIG. 4 in that LDO regulator 101 generates regulated voltage $V_{CORE}$ using either of unregulated input voltage $V_{RAW}$ supplied to a first regulator circuit 110 by way of a first input terminal A, or regulated input voltage $V_{I/O}$ supplied to a second regulator circuit 120 by way of a second input terminal B. First regulator circuit 110 includes a first NPN transistor (output device) M1 that is coupled between input terminal A and an output terminal O of LDO regulator 101. First regulator 101 also includes a first control circuit 115 for controlling NPN transistor M1 such that the regulated output voltage $V_{CORE}$ is generated on output terminal O immediately after unregulated input voltage $V_{RAW}$ is supplied (in particular, when voltage $V_{RAW}$ rises above a minimum voltage level). Second regulator circuit 120 includes a second NPN transistor M2 that is coupled between input terminal B and output terminal O, and a second control circuit 125 for controlling NPN transistor M2 to generate regulated output voltage $V_{CORE}$ at output terminal O when regulated input voltage $V_{I/O}$, which in this example is supplied from BUCK regulator 20, reaches a predetermined operating voltage level.

Figure 2:
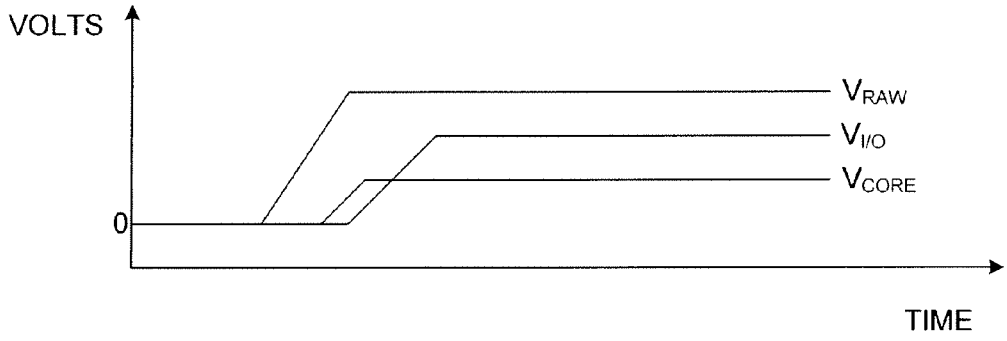
FIG. 2 is timing diagram showing voltages generated in the system of FIG. 1 at startup.

In accordance with an aspect of the present invention, LDO regulator 101 includes an internal priority logic scheme, which is represented by a prioritizing circuit 130, that allows controls LDO circuit 101 such that regulated output voltage $V_{CORE}$ will be generated from either of regulator circuits 110 or 120 (i.e., from either unregulated input voltage $V_{RAW}$ received at input terminal A, or regulated input voltage $V_{I/O}$ received at input terminal B), but is biased to utilize regulator circuit 120 when regulated input voltage $V_{I/O}$ is present on input terminal B. In particular, the internal priority logic scheme of LDO regulator 101 disables control circuit 115 of first regulator circuit 110 (i.e., to turn off NPN transistor M1) when regulated input voltage $V_{I/O}$ is at a sufficient voltage level (e.g., above a predetermined minimum voltage level) to generate regulated output voltage $V_{CORE}$ by way of regulator circuit 120. As depicted in FIG. 2, this arrangement allows the LDO circuit 101 to begin operation as soon as unregulated supply voltage $V_{RAW}$ (e.g., a 5V raw bus) is available, thus providing regulated output voltage $V_{CORE}$ before the slower (but more efficient) switching regulator 20 is able to generate regulated voltage $V_{I/O}$. Once the operation of switching regulator 20 reaches a state in which regulated voltage $V_{I/O}$ has reached the predetermined minimum, regulator circuit 120 begins to generate regulated output voltage $V_{CORE}$, and prioritizing circuit 130 generates a disable signal $V_{DA}$ that causes control circuit 115 to turn off NPN transistor M1. Because the voltage level of regulated voltage $V_{I/O}$ (e.g., 3.5V) is closer to regulated output voltage $V_{CORE}$ (e.g., 2.5V) than unregulated voltage $V_{RAW}$ (e.g., 5V to 7V), using regulator circuit 120 to generate regulated output voltage $V_{CORE}$ once regulated voltage $V_{I/O}$ is available allows LDO circuit 101 to operate at greater efficiency (i.e., by reducing power consumption and preventing unnecessary heating that would occur if regulated output voltage $V_{CORE}$ were generated solely using regulator circuit 110).

In accordance with another aspect of the present invention, because regulator circuit 110 is only operated for a brief period until regulated voltage $V_{I/O}$ is available, and because regulator circuit 120 operates continuously, once regulated voltage $V_{I/O}$ is available, at a voltage level closer to the drop-out voltage, NPN transistor M1 has a smaller size (i.e., reduced width because of larger voltage drop) than NPN transistor M2. In one embodiment, a ratio between the sizes (areas) associated with NPN transistor M1 and M2 is in the range of 5 to 1 (where VA is much larger than VB), and more particularly in the range of 1.5 to 1 if the two voltages are more similar.

Figure 3:
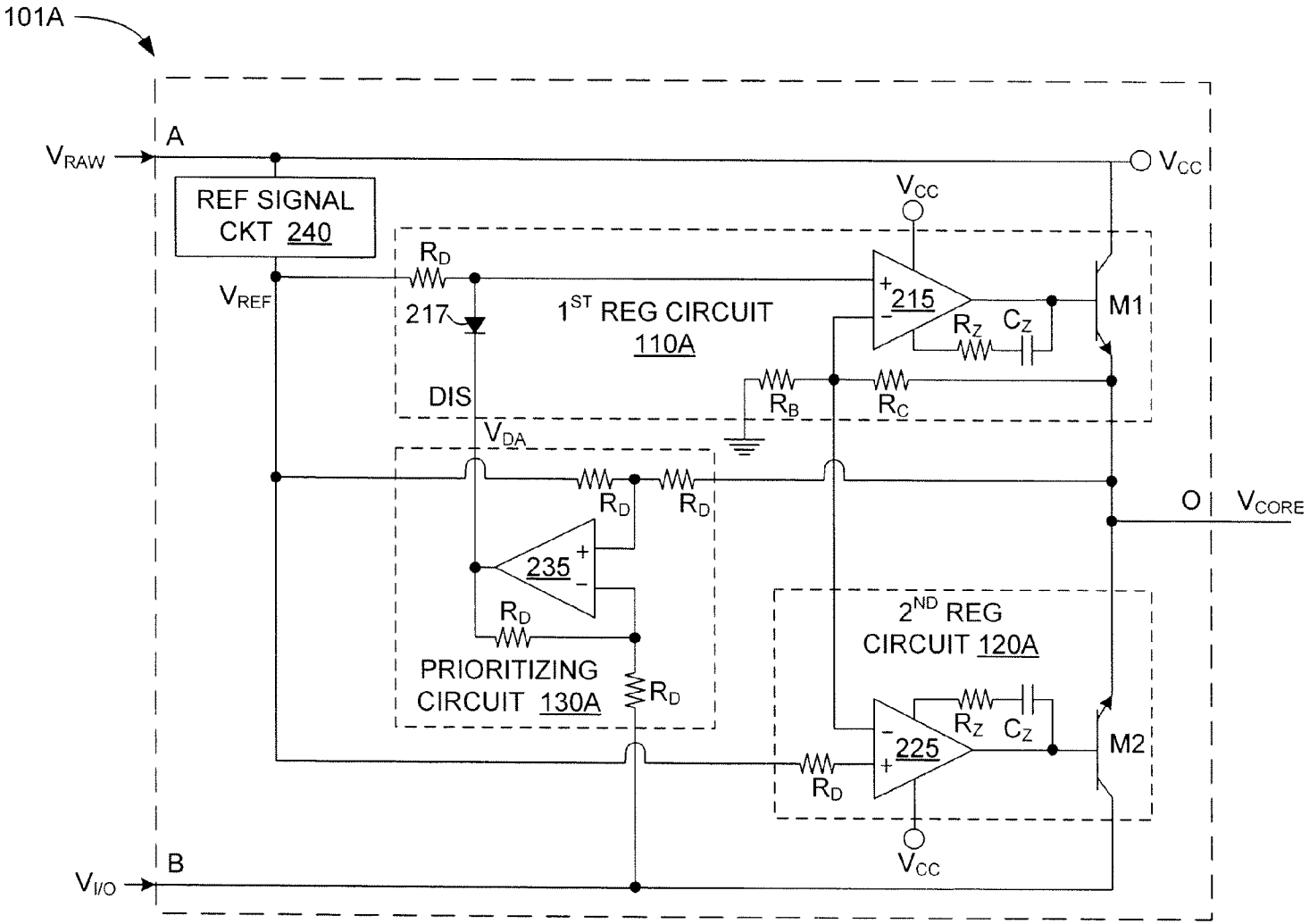
FIG. 3 is a simplified circuit diagram showing a dual input prioritizing LDO regulator according to another embodiment of the present invention.

FIG. 3 is a simplified circuit diagram showing a dual input prioritizing LDO regulator 101A according to an exemplary specific embodiment of the present invention. LDO regulator 101A includes a first regulator circuit 110A connected to first input terminal A, a second regulator circuit 120A connected to a second input terminal B, a prioritizing circuit 130A, and a reference signal circuit (REF SIGNAL CKT) 240.

In accordance with another aspect of the present invention, both regulator circuits 110A and 120A include error amplifiers operating from a single reference signal $V_{REF}$ that is generated by reference signal circuit 240. First regulator circuit 110A includes a first error amplifier 215 having an inverting input terminal (−) coupled to output terminal O by way of a resistor divider formed by resistors $R_B$ and $R_C$, and a non-inverting input terminal (+) coupled to reference source 240 by way of a first resistor $R_D$. Second regulator circuit 120A includes a second error amplifier 225 having an inverting input terminal (−) coupled to output terminal O by way of the resistor divider formed by resistors $R_B$ and $R_C$, and a non-inverting input terminal (+) coupled to reference source 240 by way of a second resistor $R_D$. Nominal values for resistors $R_B$, $R_C$ and $R_D$ are 10K to 100 k, with ratios appropriate to the reference voltage and output voltage for the particular design. Values of $R_Z$ and $C_Z$ are selected to maximize stability and transient performance for a given load range and output capacitor. In particular, $R_Z$ and $C_Z$ must provide sufficient gain and phase margin to prevent oscillation under a range of load conditions, and should be chosen to minimize transient undershoots and overshoots during step changes in load. In a typical regulator, $R_Z$ would be in the range of 50 kΩ to 500 kΩ and $C_Z$ would range from 5 pF to 50 pF depending on the particular details of the adjacent circuitry.

In accordance with another aspect of the present invention, prioritizing circuit 130A includes a differential amplifier 235 having an inverting input terminal (−) coupled to the input terminal B by way of a third resistor $R_D$, a non-inverting input terminal (+) coupled to the reference signal source 240 and to output terminal O by way of fourth and fifth resistor $R_D$, and an output terminal that is coupled to its inverting input terminal by way of a sixth resistor $R_D$, and to the non-inverting input terminal of error amplifier 215 by way of a diode 217.

During operation, differential amplifier 235 determines the operating state of second regulator circuit 120A, and controls the operation of first regulator circuit 110A accordingly.

At startup, when unregulated voltage $V_{RAW}$ is high enough to allow regulation (i.e., greater than target output voltage $V_{CORE}$ plus a dropout voltage), first regulator circuit 110A is enabled and generates output voltage $V_{CORE}$ at the target voltage level, thereby supplying a load that can be used, for example to drive the core logic circuitry of an FPGA (as depicted in FIG. 1). In particular, while $V_{RAW}$ is high enough to allow regulation, but regulated voltage $V_{I/O}$ is not, differential amplifier 235 generates a high output voltage that back-biases diode 217, thus maintaining a relatively high reference voltage on the non-inverting input terminal of error amplifier 215, thereby causing error amplifier 215 to generate a high output voltage onto the base of NPN transistor M1. Note that during the startup period the feedback voltage passed to the inverting input terminal of error amplifier 225 is lower than the reference voltage passed to the non-inverting input terminal, thereby causing error amplifier 225 to also generate a high output signal on the base of NPN transistor M2. However, because regulated voltage $V_{I/O}$ remains is not high enough to allow regulation, no current passes through NPN transistor M2 (i.e., second regulator circuit 120A fails to produce regulated output voltage $V_{CORE}$).

Subsequently, when the regulated voltage $V_{I/O}$ applied to input terminal B rises enough to allow regulation, second regulator circuit 120A takes over (i.e., current is generated through NPN transistor M2 to output terminal O), and differential amplifier 235 pulls down the reference signal supplied to the non-inverting input terminal of first error amplifier 215, thereby turning off NPN transistor M1. In particular, differential amplifier is turned off (i.e., generates a low output voltage) when the portion of regulated voltage $V_{I/O}$ applied to the inverting input terminal of differential amplifier 235 rises above the reference voltage supplied to the non-inverting input terminal of differential amplifier 235. The low output voltage from differential amplifier 235 forward biases diode 217, thus causing the reference signal applied to the non-inverting terminal of error amplifier 215 to drop to a low voltage level. This low voltage level on the the non-inverting terminal of error amplifier 215 causes the output voltage generated by error amplifier 215 to switch to a low output voltage, thus turning off PNP transistor M1. Thus, when regulated input voltage $V_{I/O}$ is high enough to allow second regulator circuit 120A to operate, first regulator circuit 110A is shut down.

While the present invention is described with respect to specific embodiments, those skilled in the art will recognize that other circuit structures and methods may be utilized to achieve the spirit and scope of the present invention, all of which are intended to fall within the scope of the present invention. For example, the differential amplifier of LDO regulator 101A (FIG. 3) can be eliminated if first regulator circuit 110A has a slightly lower output voltage than that of second regulator circuit 120A. In this case, the switchover is automatically accomplished by the OR'ing nature of the connected emitters. Similar effects occur if output devices are PNP or PMOS collectors or drains.

The invention claimed is:

1. A dual input prioritizing linear regulator for generating a regulated output voltage, the linear regulator comprising:

a first voltage input terminal for receiving an unregulated input voltage;

a second voltage input terminal for receiving a regulated input voltage;

an output voltage terminal;

a first regulator circuit including a first output device coupled between the first voltage input terminal and the output voltage terminal, and a first control circuit for controlling the first output device such that the regulated output voltage is generated on the output voltage terminal while the unregulated input voltage is above a predetermined first minimum voltage level;

a second regulator circuit including a second output device coupled between the second voltage input terminal and the output voltage terminal, and a second control circuit for controlling the second output device such that the regulated output voltage is generated on the output voltage terminal while the regulated input voltage is above a predetermined second minimum voltage level; and means for disabling the first control circuit while the regulated input voltage is above the predetermined second minimum voltage level.

2. The dual input prioritizing linear regulator according to claim 1, wherein the first and second output devices are transistors, and wherein the first output device is smaller than the second output device.

3. The dual input prioritizing linear regulator according to claim 2, wherein the first and second output devices are bipolar transistors.

4. The dual input prioritizing linear regulator according to claim 1, wherein the first regulator circuit comprises a first error amplifier having a first input terminal coupled to the output voltage terminal, and a second input terminal coupled to a reference signal source, and wherein the second regulator circuit comprises a second error amplifier having a first input terminal coupled to the output voltage terminal, and a second input terminal coupled to the reference signal source.

5. The dual input prioritizing linear regulator according to claim 4, further comprising a voltage divider connected between the output voltage terminal and the first input terminals of the first and second regulator circuits.

6. The dual input prioritizing linear regulator according to claim 4, wherein said means for disabling the first control circuit comprises a differential amplifier having a first input terminal coupled to the second voltage input terminal, a second input terminal coupled to the reference signal source and to the output voltage terminal, and an output terminal that is coupled to the second input terminal of the first error amplifier.

7. The dual input prioritizing linear regulator according to claim 6, wherein the first regulator circuit further comprises a diode having an anode connected to the second input terminal of the first error amplifier, and a cathode connected to the output terminal of the differential amplifier.

8. A system including:

means for providing an unregulated supply voltage;

a device including input/output (I/O) circuitry and core logic circuitry;

a switching regulator for generating a relatively high regulated supply voltage in response to the unregulated supply voltage; and a dual input prioritizing linear regulator for generating a relatively low regulated voltage, the linear regulator comprising:

a first voltage input terminal connected to receive the unregulated input voltage;

a second voltage input terminal connected to receive the relatively high input voltage;

an output voltage terminal coupled to the I/O circuitry of the device;

a first regulator circuit including a first output device coupled between the first voltage input terminal and the output voltage terminal, and a first control circuit for controlling the first output device such that the regulated output voltage is generated on the output voltage terminal while the unregulated input voltage is above a predetermined first minimum voltage level;

a second regulator circuit including a second output device coupled between the second voltage input terminal and the output voltage terminal, and a second control circuit for controlling the second output device such that the regulated output voltage is generated on the output voltage terminal while the regulated input voltage is above a predetermined second minimum voltage level; and means for disabling the first control circuit while the regulated input voltage is above the predetermined second minimum voltage level.

* * * * *